US005129843A

United States Patent [19]

Bowsky et al.

[11] Patent Number: 5,129,843

[45] Date of Patent: Jul. 14, 1992

[54] CONNECTOR BLOCK FOR A TERMINAL ASSEMBLY

[75] Inventors: Benjamin Bowsky, Ballwin, Mo.; James F. Horn, Sidney, Ohio

[73] Assignee: Emerson Electric Co., St. Louis, Mo.

[21] Appl. No.: 717,536

[22] Filed: Jun. 19, 1991

[51] Int. Cl.[5] ..... H01R 21/00

[52] U.S. Cl. ..... 439/685; 439/181

[58] Field of Search ..... 439/181-186, 439/685, 935, 907, 677, 680

[56] References Cited

U.S. PATENT DOCUMENTS

| | | | |
|---|---|---|---|
| 2,728,060 | 12/1955 | Doeg . | |
| 3,721,948 | 3/1973 | Brandt . | |
| 3,777,302 | 12/1973 | Travis | 439/685 X |
| 3,850,496 | 11/1974 | Hague . | |
| 3,853,388 | 12/1974 | Heimbrock | 439/685 |
| 3,917,377 | 11/1975 | Hall et al. | 439/685 X |
| 4,059,325 | 11/1977 | Diminnie . | |
| 4,611,138 | 9/1986 | Kindig et al. . | |
| 4,748,531 | 5/1988 | Ortiz . | |
| 4,753,607 | 6/1988 | Heimbrock . | |
| 4,966,559 | 10/1990 | Wisner . | |

FOREIGN PATENT DOCUMENTS 2549646 1/1985 France .

*Primary Examiner*—Larry I. Schwartz
*Assistant Examiner*—Khiem Nguyen
*Attorney, Agent, or Firm*—Polster, Lieder, Woodruff & Lucchesi

[57] ABSTRACT

An electrical connector pin assembly including at least one conductor pin extending in sealed relation through a housing wall of a chamber and a lead wire connector block having an over-surface wall shield extending from the outer face of the connector block to surround and minimize arcing from a conductor pin end portion extending into the connector block for electrical engagement with a lead wire end.

7 Claims, 1 Drawing Sheet

FIG> 6

CONNECTOR BLOCK FOR A TERMINAL ASSEMBLY

BACKGROUND OF THE INVENTION

The present invention relates to an improved connector block for a terminal assembly and more particularly to a unitary connector block for pins of a hermetic terminal assembly which includes pin cooperative over-surface insulative shields to minimize through-space arcing by the pins.

Connector block housings for connecting lead wire ends to pins of a terminal assembly have been long known in the electrical connector art, attention being directed to connector housing 46 in long since expired U.S. Pat. No. 2,728,060, issued to R. W. Doeg on Dec. 20, 1955. In this patent such a connector block is disclosed engaging the inner pin ends of a hermetic terminal assembly used in conjunction with a shell of a refrigerator assembly. Attention further is directed to the plug member 31 of the more recent U.S. Pat. No. 4,611,138, issued to A. L. Kindig et al on Sep. 9, 1986 and the housing 42 of U.S. Pat. No. 4,748,531, issued to A. L. Ortiz on May 31, 1988. Further, it generally is well known to shield terminal pin ends with surrounding over-surface sleeves on the terminal assembly itself, particular attention being directed to the pin surrounding insulating sleeves 16 and 18 attached to the body 7 of a terminal assembly by a potting compound as disclosed in expired U.S. Pat. No. 3,721,948, issued to G. W. Brandt et al on Mar. 20, 1973. Such an arrangement further is disclosed by sleeves 33 and 34 in U.S. Pat. No. 3,850,496, issued to J. T. Hague on Nov. 26, 1974. In addition, attention is directed to the flat insulating shield 40 cooperating with the edge of cup-shaped terminal assembly 24 of U.S. Pat. No. 4,059,325, issued to E. A. Dimminie et al on Nov. 22, 1972; to the apparently singular circular boss 40 on cluster block 10 which surrounds only a portion of pin 33 to guide it into bore 30 in U.S. Pat. No. 4,753,607, issued to H. H. Heimbrock on Jun. 28, 1988; and, to the cylindrical shield wall 86 which projects from the outer face of terminal block assembly 44 to surround all of the pin ends of conductor pins 60 in U.S. Pat. No. 4,966,559, issued to R. R. Wisner on Oct. 30, 1990.

The present invention recognizes that such past terminal block arrangements have been comparatively complex in manufacture and assembly and that even when over-surface protection has been provided for individual pins, it has required potting the assembly of a number of shields to the terminal assembly with epoxy glue or other suitable material for the pins in a comparatively complex manufacturing operation and in addition has created assembly problems in fastening electrical connections to the individually shielded pins. Further, the present invention recognizes that past shield arrangements associated with electrical connector blocks have not only presented problems in complex manufacture and problems in assembly and alignment with the pin carrying terminal assembly, but past arrangements have failed to recognize the need for over-surface through-space protection between the pins of the assembly itself.

Recognizing these problems and limitations of the prior art, the present invention provides in combination with an electrical conductor pin means, a connector block arrangement which can be readily manufactured in an economical and straightforward manner and which can be readily assembled with a terminal assembly to provide quick, positive connection and over-surface through-space shielding of one or more of the corresponding pin end portions of pins sealed in the body of the terminal assembly.

Various other features of the present invention will become obvious to one skilled in the art upon reading the disclosure set forth herein.

BRIEF SUMMARY OF THE INVENTION

More particularly, the present invention provides, in combination with an electrical conductor pin means including at least one pin extending through a housing wall of a chamber to provide inner and outer pin end portions relative the chamber, an improved electrical connection to the conductor pin means comprising: a connector block to provide quick, positive electrical connection to one of the pin end portions of the conductor pin means, the connector block including first and second passageway means, the first passageway means serving to accommodate one end of lead wire means to be electrically connected to one of the pin end portions of the conductor pin means and the second passageway means serving to accommodate passage of the one pin end portion therethrough; lead wire end means disposed in the first passageway means including clip means fastened to one of the extremities thereof and positioned adjacent the second passageway means to hold the lead wire end means firmly in position adjacent the second passageway means, the clip means being sized and configured to engage in electrically contacting relation with the one end portion of the conductor pin means extending through the second passageway means; and, over-surface wall shield means fixed to and extending from the outer face of the connector block, the wall shield means being positioned and configured to extend adjacent the part of that end portion of the conductor pin extending through the second passageway remaining outside the connector block to minimize possible arcing of the pin.

It is to be understood that various changes can be made by one skilled in the art in one or more of the several parts of the embodiment disclosed without departing from the scope or spirit of the present invention and in the particular utilization of the inventive arrangement. In this regard, although the novel structural arrangement is disclosed in use on the inner, low pressure (suction) side of a hermetically sealed housing where through-space pin arcing is more likely to occur, it is to be understood that such an arrangement can be employed on the outer side of such a housing and that the number of conductor pins and accompanying individual shields can be varied, as can the geometric shield configuration.

BRIEF DESCRIPTION OF THE DRAWINGS

Referring to the drawing which discloses one advantageous embodiment of the present invention and a modification thereof:

FIG. 6 is an isometric view of a modified shield version of the inventive connector block.

DETAILED DESCRIPTION OF THE DRAWINGS

Figure 1:
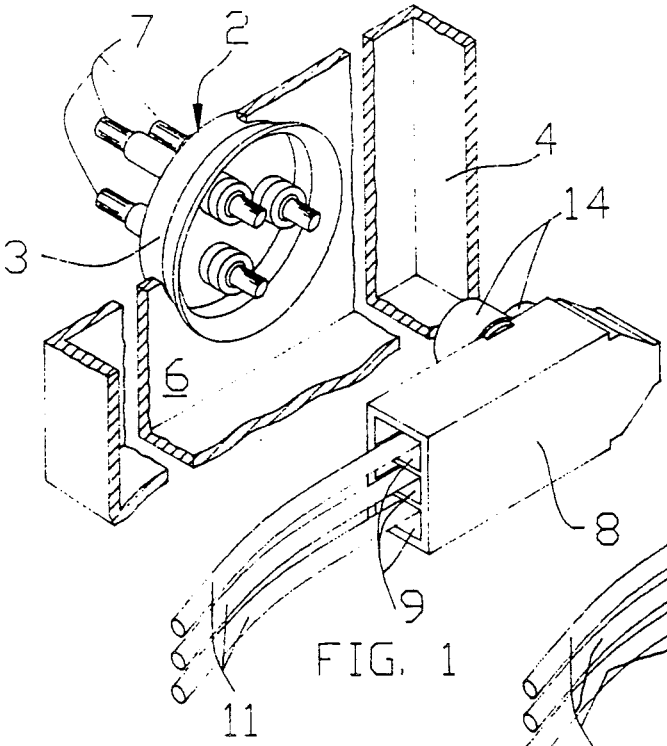
FIG. 1 is an expanded isometric view of the novel inventive combination disclosing the inner pin end portions of a hermetic terminal assembly projecting through the partially disclosed, broken away wall of a hermetically sealed chamber and the novel connector for the pin end portions.
Figure 5:
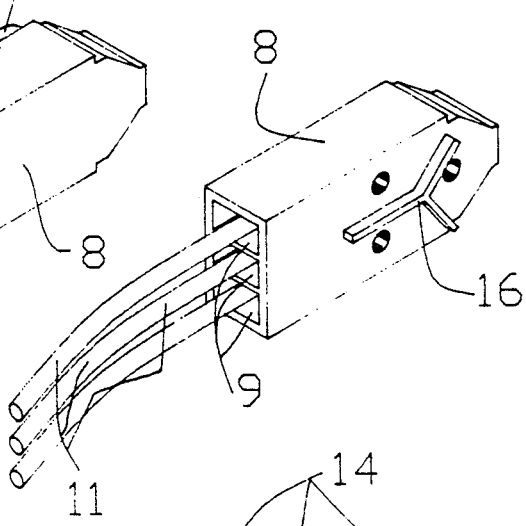
FIG. 5 is a front end view of the connector block of FIG. 1.
Figure 5:
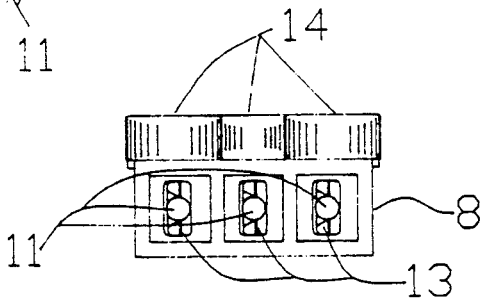

Referring to the isometric view of FIG. 1 of the drawing, an electrical conductor pin structure in the form of a terminal assembly 2 of a type known in the art can be seen assembled with its cup-shaped body 3 extending through and sealed along the peripheral rim thereof to an aperture in the wall 4 of a hermetically sealed compressor chamber 6. Extending in sealed relation through the base of cup-shaped body 3 are three spaced electrical conductor pins 7 to provide three spaced conductor pin end portions which extend into the low pressure (suction) side of the hermetically sealed compressor chamber 6. The structure described so far is typical in the compressor art and therefore specific details of the terminal assembly 2 are omitted. It only is essential to note that the inner pin end portions of pins 7 are on the low pressure side of wall 4 where conductor pin arcing is more likely to occur and the improved electrical connection finds more utility. However, it is to be understood that the novel electrical connection can be efficiently and effectively used in other pin environments and, in fact, it could be desirable to even use such a pin connection on the outer pin end portions of a terminal assembly. It further is to be understood that the present invention is not to be considered as limited for use only with three pin assemblies, but can be adapted for use with one, two or other plural pin clusters with the inventive connector block described hereinafter being appropriately modified to accommodate the number of pins in the terminal assembly with which it is to be associated.

Figure 2:
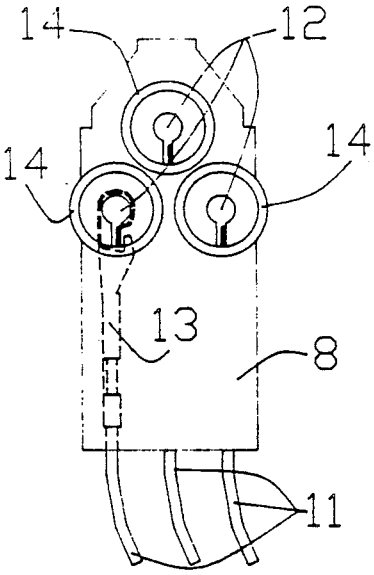
FIG. 2 is a front side view of the connector block of FIG. 1 with one of the lead wire ends and clip shown in phantom.
Figure 3:
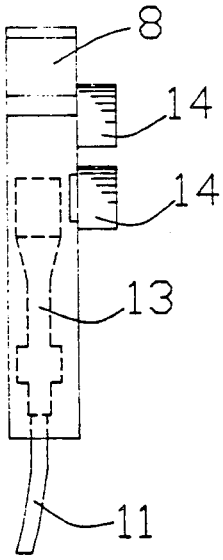
FIG. 3 is another side view of the connector block of FIG. 1.
Figure 4:
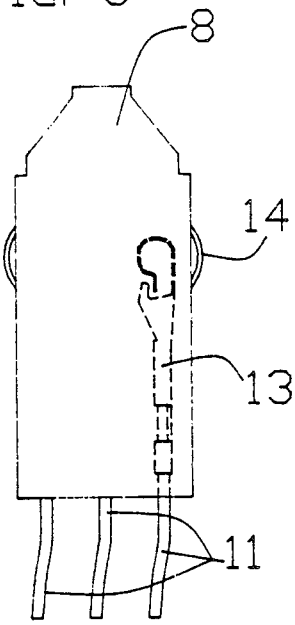
FIG. 4 is a rear face view of the connector block of FIG. 1.

Still referring to FIG. 1 of the drawing and also to FIGS. 2–4, a unitary plastic block incorporating the novel features of the present invention can be seen. Block 8 can be mold formed from any one of a number of known plastic compounds, advantageously with hard, insulative physical properties. To cooperatively engage with the inner ends of the three pins 7 of hermetic terminal assembly 2, block 8 includes three longitudinally extending separately spaced first passageways 9 having lead wire end openings at one extremity thereof. These first passageways 9 serve to accommodate three lead wire ends 11 of lead wires which can be appropriately and electrically connected to a motor or other unit (not shown) which can be disposed in the hermetically sealed chamber defined by walls 4. The first passageways 9 are each communicatively connected to one of three spaced openings or second passageways 12 (FIG. 2) which are appropriately spaced at the other end of plastic block 8 to receive therethrough the inner end portions of pins 7 of hermetic terminal assembly 2. Spaced passageways 12 advantageously are of key-shaped cross-section to allow for clip positioning and locking. Each of lead wire ends 11 has a looped pin receiving clip 13 electrically fastened to its extremity to yieldingly receive one of the inner end portions of pins 7 passing through communicating passageway 12. Clips 13 fastened to lead wire ends 11 can be selected from any one of a number of electrically contacting type clips known in the electrical art and advantageously each clip 13 includes a detent arrangement to hold the clip and the lead wire end to which it is connected in a fast preselected position adjacent second passageway 12 so as to electrically engage in yielding contact with the inner end portion of a pin 7 passing through passageway 12.

As can be seen in the drawing and in accordance with the present invention, plastic block 8 includes three spaced over-surface open-ended cylindrical wall shields 14, each integrally molded unto the outer surface of plastic block 8. Each cylindrical wall shield 14 is positioned adjacent to and surrounds one of the key shaped second passageways 12 so as to extend coextensively with that part of the inner pin end portion of conductor pin 7 located outside passageway 12, thus minimizing possible through-space arcing of each of the spaced inner pin end portions with the other pin end portions or other surfaces when the end portions are in yielding engagement with looped clips 13. It is to be understood that the shape and number of wall shields can be varied in accordance with the terminal assembly pins with which they are to be associated and that, although advantageously disclosed as being an integrally molded part of block 8 can be separately assembled and joined to the block as the occasion might require.

As can be seen in FIG. 6 of the drawing, a modified embodiment of the shield shape is disclosed as including an integral three-legged Y-shaped wall 16 with the legs positioned to separate and shield each end portion part of the inner ends of pins 7 outside block 8 from the other such pin portions and other surfaces when the pin end portions are engaged with the block 8.

The invention claimed is:

1. In combination with an electrical conductor pin means including at least one pin extending through a housing wall of a chamber to provide inner and outer pin end portions relative to said chamber, an improved electrical connection to said conductor pin means comprising:

a connector block to provide quick, positive electrical connection to one of said pin end portions of said conductor pin means, said connector block including first and second passageway means, said first passageway means serving to accommodate one end of lead wire means to be electrically connected to one of said pin end portions of said conductor pin means and said second passageway means serving to accommodate passage of said one pin end portion therethrough; lead wire end means disposed in said first passageway means including clip means fastened to one of the extremities of said lead wire end means to be positioned adjacent said second passageway means to hold said lead wire end means firmly in position adjacent said second passageway means, said clip means being sized and configured to engage in electrically contacting relation with said one end portion of said conductor pin extending through said second passageway means; and, over-surface wall shield means fixed to and extending from the outer face of said connector block, said wall shield means being positioned and configured to extend in radially spaced surrounding relation adjacent and surround substantially the entirety of an end portion part of said conductor pin remaining outside said connector block after said conductor pin extends through said second passageway to minimize possible arcing of said pin.

2. The improved electrical connection structure of claim 1, wherein said connector block including said passageways and over-surface wall shield means being of an integral unitary plastic material.

3. The improved electrical connection structure of claim 1, wherein said connector block being disposed to provide an electrical connection to engage in electrically contacting relation with said inner pin end portion of said conductor pin means.

4. The improved electrical connection structure of claim 1 wherein said conductor pin means includes at least two spaced pins extending through said housing wall of said chamber with said connector block including at least two spaced longitudinally extending insulated first passageways, at least two spaced second passageways, each of said insulated longitudinally extending first passageways including a lead wire end having a clip fastened thereto adjacent one of said spaced second passageways to hold said lead wire end firmly in position to engage in electrically contacting relation with one of said corresponding ends of said conductor pin end portions and said over-surface wall shield means being positioned and configured to extend in radially spaced surrounding relation adjacent substantially the entirety of those parts of said pin end portions extending through said spaced second passageways which remain outside said connector block to minimize possible arcing.

5. The improved electrical connection structure of claim 4, wherein each of said second passageways being of key shaped contour to accommodate for clip means positioning and locking.

6. The improved electrical connection structure of claim 4, wherein said over-surface wall means comprising spaced, open-ended cylindrical walls positioned adjacent to and surrounding each of said second passageways.

7. In combination with an electrical conductor pin structure in the form of a unitary hermetic terminal assembly for a hermetically sealed electrical compressor including a cup-shaped body extending through and sealed to an aperture in the wall of a hermetically sealed chamber for said electrical compressor, said cup-shaped body including three spaced conductor pins extending therethrough in sealed relation therewith to provide three spaced inner conductor pin end portions, each provided with a surrounding pin insulation portion extending into the low pressure (suction) side of said hermetically sealed compressor chamber, an improved electrical connection for said spaced inner conductor pin end portions comprising:

a unitary plastic block including three longitudinally extending insulated first passageways and three key-shaped second passageways communicating with said first passageways, said longitudinally extending first passageways each serving to accommodate one end of a lead wire to be electrically connected to one of said inner pin ends of said terminal assembly and said second key-shaped passageways each serving to allow passage therethrough of one of said three spaced inner pin end portions of said terminal assembly;

three lead wire ends of three lead wires connected to electrically driven machinery in said hermetically sealed chamber, said three lead wire ends each being disposed in one of said insulated first passageways, each of said lead wire ends including a looped clip fastened to one of the extremities of one of said lead wire ends and fixedly positioned adjacent one of said second key-shaped communicating passageways to hold said lead wire end firmly in locked position adjacent said second key-shaped communicating passageway, said looped clip being sized and configured to engage in yielding electrically contacting relation with said inner end portion of said conductor pin extending through said second key-shaped passageway; and, three spaced over-surface open-ended cylindrical wall shields, each positioned adjacent to and surrounding one of said key-shaped second passageways to extend coextensively in radially spaced surrounding relation with substantially the entirety of that part of said inner pin end portion of said conductor pin to contact said surrounding pin insulation portions outside said second key-shaped passageways to minimize possible arcing.

* * * * *